US005815115A

United States Patent [19]

Carloni et al.

[11] Patent Number: 5,815,115

[45] Date of Patent: Sep. 29, 1998

[54] HIGH SPEED WIRELESS TRANSMITTERS AND RECEIVERS

[75] Inventors: Manuel J. Carloni, Holmdel; Michael James Gans, Monmouth Beach; Peter Wasily Wolniansky, Ocean Grove, all of N.J.

[73] Assignee: Lucent Technologies Inc., Murray Hill, N.J.

[21] Appl. No.: 578,292

[22] Filed: Dec. 26, 1995

[51] Int. Cl.[6] ..... H01Q 3/00

[52] U.S. Cl. ..... 342/359; 455/506; 455/65

[58] Field of Search ..... 342/359, 372; 455/506, 65

[56] References Cited

U.S. PATENT DOCUMENTS

| | | | |
|---|---|---|---|
| 3,917,998 | 11/1975 | Welti . | |
| 4,316,192 | 2/1982 | Acoraci . | |
| 4,596,986 | 6/1986 | Andrews et al. . | |
| 4,612,518 | 9/1986 | Gans et al. . | |
| 4,696,053 | 9/1987 | Mastriani et al. . | |
| 4,789,983 | 12/1988 | Acampora et al. . | |
| 4,837,786 | 6/1989 | Gurantz et al. . | |
| 4,882,588 | 11/1989 | Renshaw et al. . | |
| 4,951,061 | 8/1990 | Lee . | |
| 4,975,926 | 12/1990 | Knapp . | |
| 5,054,052 | 10/1991 | Nonami . | |
| 5,086,302 | 2/1992 | Miller . | |
| 5,089,823 | 2/1992 | Vasile . | |
| 5,119,375 | 6/1992 | Paneth et al. | 370/95.1 |
| 5,134,417 | 7/1992 | Thompson . | |
| 5,218,356 | 6/1993 | Knapp | 342/350 |
| 5,487,069 | 1/1996 | O'Sullivan et al. | 370/94.3 |

OTHER PUBLICATIONS

D.M.J. Devasirvatham, "Time Delay Spread Measurements of Wideband Radio Signals Within a Building", Electronics Letters, vol. 20, No. 23, Nov. 8, 1984, pp. 950–951.

P.F. Driessen, "High Speed Indoor Wireless Systems With Directional Antennas", Proceedings of VTC '94, Stockholm, Sweden, Jun. 7–10, 1994, pp. 664–668.

T.A. Freeburg, "Enabling Technologies for Wireless In–Building Network Communications—Four Technical Challenges, Four Solutions", IEEE Communications Magazine, Apr. 1991, pp. 58–64.

M.J. Gans et al., "A 2.5 Gigabit 23–Mile Radio Link for LuckyNet", Proceedings of Globecom '91, Dec. 2–5, 1991, pp. 1065–1068.

J.D. Kraus, Antennas, McGraw–Hill: New York, 1950, pp. 25, 54, and 56.

A.A.M. Saleh et al., "A Statistical Model for Indoor Multipath Propagation", IEEE Journal on Selected Areas in Communications, vol. SAC–5, No. 2, Feb. 1987, pp. 128–137.

H. Taub et al., Principles of Communication Systems, McGraw–Hill, New York, 1971, pp. 380–381 and pp. 490–491.

R. Trambarulo et al., "High–Speed QPSK Modulator and Demodulator with Subharmonic Pumping", IEEE Transactions on Microwave Theory and Techniques, vol. 36, No. 12, Dec. 1988, pp. 1714–1719.

R.A. Valenzuela, "A Ray Tracing Approach to Predicting Indoor Wireless Transmission", Proceedings of VTC '93, Secaucus, New Jersey, May 18–20, 1993, pp. 214–218.

*Primary Examiner*—Theodore M. Blum

[57] ABSTRACT

A wireless transmitter and receiver are used in a wireless telecommunication system and method including antennas having at least one antenna element with a relatively narrow beamwidth at both the transmitter and receiver for high data rate communication. The antenna element provides beam coverage in both azimuthal and elevational directions, and a processor is operatively connected to the antenna and is capable of determining a suitable communication path with respect to the at least one antenna element and predetermined communications conditions.

29 Claims, 9 Drawing Sheets

HIGH SPEED WIRELESS TRANSMITTERS AND RECEIVERS

BACKGROUND INFORMATION

1. Technical Field

This disclosure relates to wireless transmitters and receivers for high speed wireless communications. More particularly, this disclosure relates to high speed wireless transmitters and receivers using narrow beamwidth antennas.

2. Description of the Related Art

Wireless telecommunication systems have been developed implementing various transmission techniques to achieve wireless communications at high data rates on the order of Megabits per second. For example, cordless radio telephone systems have been implemented which permit telephones to communicate via radio to a localized antenna connected to a base station. Infrared telecommunication systems for transmitting two-way data communications in the infrared spectrum have also been developed.

More recently, a wireless telecommunication system for wideband communications using radio is presented in Acampora et al., U.S. Pat. No. 4,789,983, issued Dec. 6, 1988, which includes a plurality of transceivers associated with separate users of the system, and a central node capable of providing duplex communications using a wireline connection and a radio channel with certain subgroups of transceivers.

Other wireless systems are presented in T. A. Freeburg, "Enabling Technologies for Wireless In-Building Network Communications—Four Technical Challenges, Four Solutions", IEEE COMMUNICATIONS MAGAZINE, April 1991, pp. 58–64. In T. A. Freeburg, supra at p. 63, a system employs six equal 60° azimuth directional antennas with a single elevational beamwidth coverage to operate at 15 Megabits per second for both transmit and receive. Such a large beamwidth of 60° azimuth and a single elevational beamwidth coverage are used to achieve a predetermined gain.

Such communication techniques do not overcome the signal power margin and multipath delay spread phenomena encountered at data rates of tens of Megabits per second to data rates in excess of 1 Gigabits per second.

SUMMARY

A wireless transmitter and receiver are disclosed for use in a wireless telecommunication system and method including antennas having at least one antenna element with a relatively narrow beamwidth at both the transmitter and receiver for high data rate communication. The antenna element provides beam coverage in both azimuthal and elevational directions; and a processor is operatively connected to the antenna and is capable of determining a suitable communication path with respect to the at least one antenna element and predetermined communications conditions.

BRIEF DESCRIPTION OF THE DRAWINGS

The features of the disclosed high data rate wireless transmitter and receiver and method of operation will become more readily apparent and can be better understood by referring to the following detailed description of an illustrative embodiment, taken in conjunction with the accompanying drawings, where.

DESCRIPTION OF THE ILLUSTRATIVE EMBODIMENTS

Figure 1:
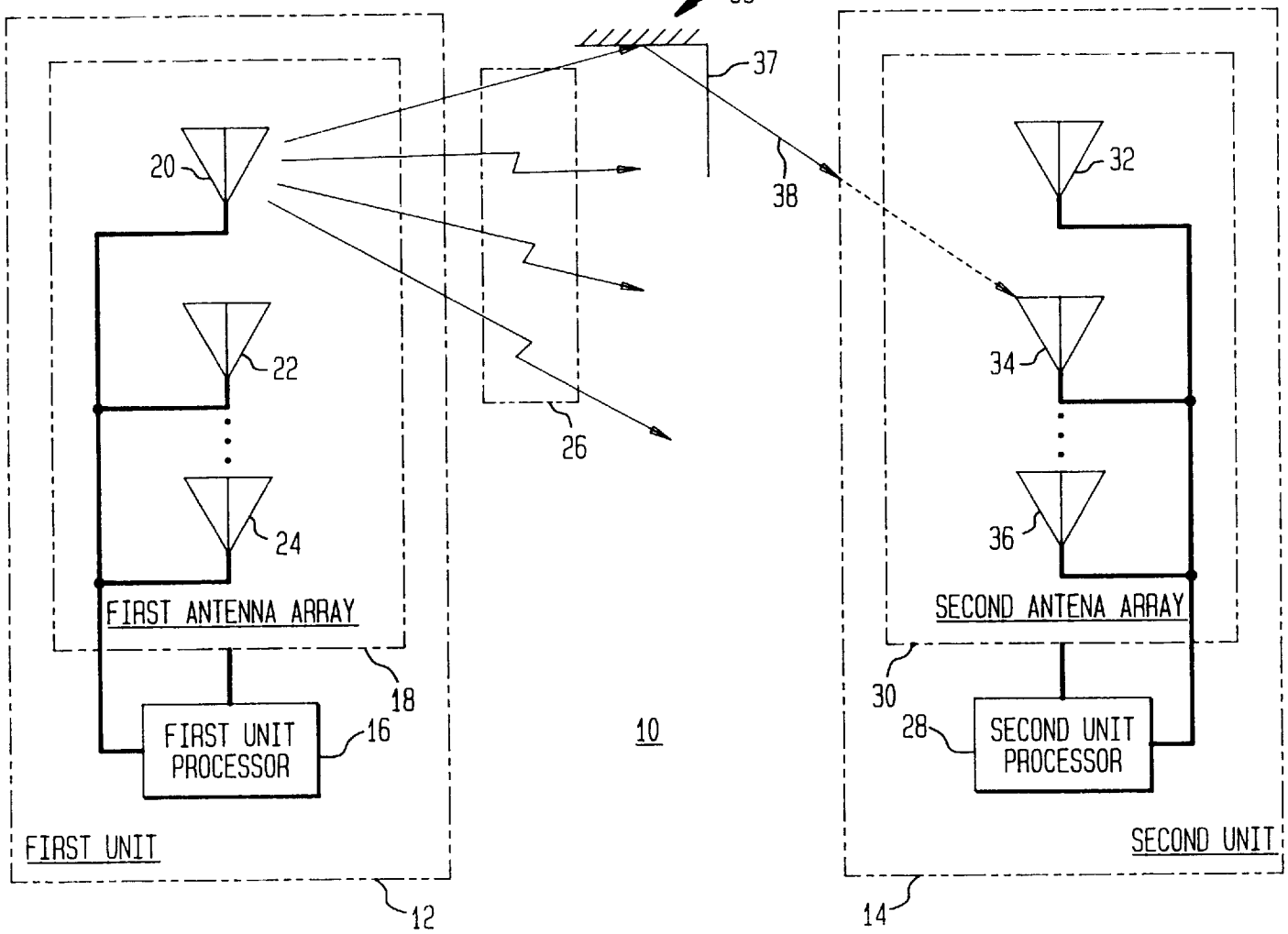
FIG. 1 illustrates a wireless telecommunications system for high speed wireless communication.

Referring now in specific detail to the drawings, with like reference numerals identifying similar or identical elements, as shown in FIG. 1, a wireless transmitter and a wireless receiver, respectively, are adapted for use in a wireless telecommunication system and method capable of high data rate communication. Such a wireless telecommunication system and method are disclosed in commonly assigned U.S. patent application Ser. No. 08/404,406, filed Mar. 14, 1995, which is incorporated herein by reference, and which can be used in indoor settings, such as within and between rooms in a building.

Some embodiments use narrow beamwidth antennas to increase the power margin and to decrease the delay spread of signals at the receiver to isolate a single ray. Such narrow beamwidth antennas permit wireless data communications at high data rates in closed environments using, for example, bursty transmissions and asynchronous communications. Typical embodiments are capable of data transmission rates which exceed 1 Gigabits per second with propagation losses of about 60 dB relative to one meter.

As illustrated in FIG. 1, system 10 includes first unit 12 and at least one second unit 14 for establishing communications therebetween. In an exemplary embodiment, each of first unit 12 and second unit 14 can be either a base station or a remote station. First unit 12 includes first unit processor 16 operatively connected to first antenna array 18. First antenna array 18 includes a plurality of array elements 20, 22, 24 for transmitting signals 26 to at least one second unit 14.

Each second unit 14 includes respective second processor 28 which is operatively connected to second antenna array 30. The second antenna array 30 includes a plurality of array elements 32, 34, 36. Second unit 14 receives signals 26 at second antenna array 30 which passes received signals 26 to second processor 28.

System 10 preferably transmits and receives such signals 26 using array elements 20–24 and 32–36 which can be oriented, selected, and/or phased to determine an advantageous or suitable communication path 38 meeting a predetermined signal power and delay of received signals 26 as discussed below. For example, the advantageous or suitable communication path in the illustrative scenario of FIG. 1 is depicted as propagating from antenna array element 20 of first antenna array 18 to antenna array element 34 of second antenna array 30. The communication path or ray can also be reflected off wall 39 and can pass through wall 37.

Each of array elements 20–24 and 32–36 can include narrow beamwidth antennas having horns or waveguides with an azimuth and elevation beamwidth less than about 30° to permit high data rate communications between a base station and at least one remote station in excess of about 10 Megabits per second.

Figure 2:
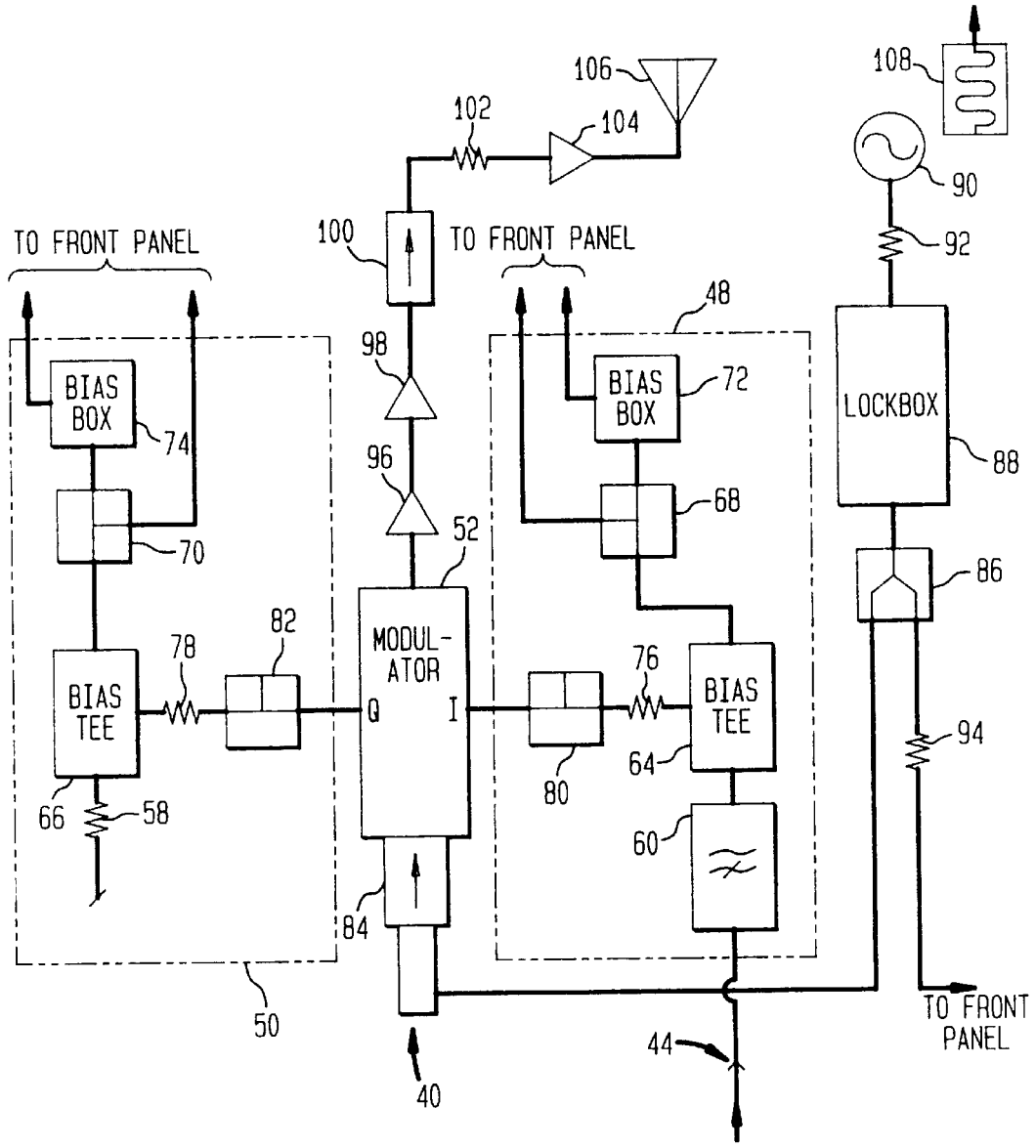
FIG. 2 illustrates a high speed wireless transmitter configured for binary phase shift keying transmission.
Figure 3:
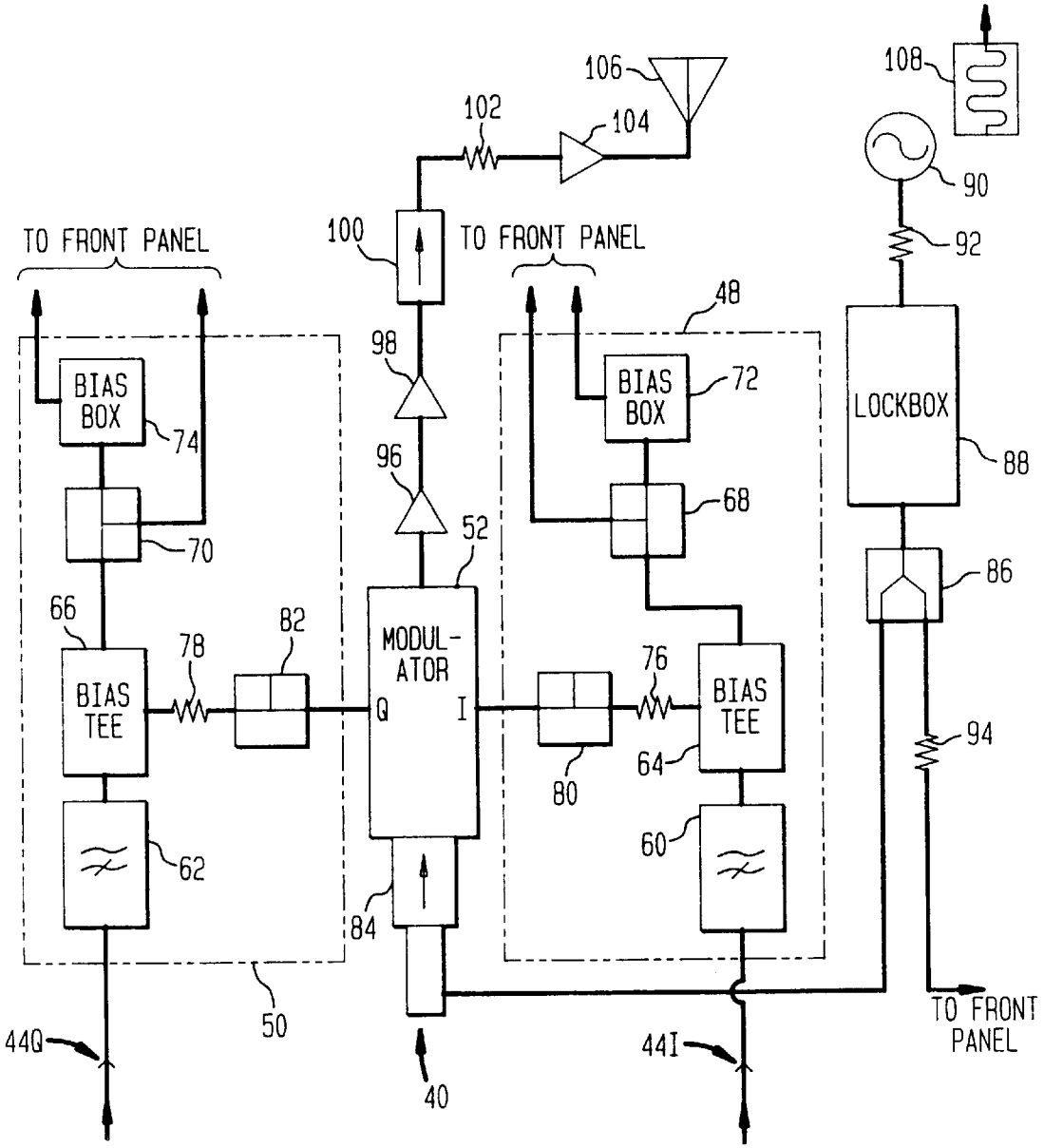
FIG. 3 illustrates a high speed wireless transmitter configured for quadrature phase shift keying transmission.
Figure 4:
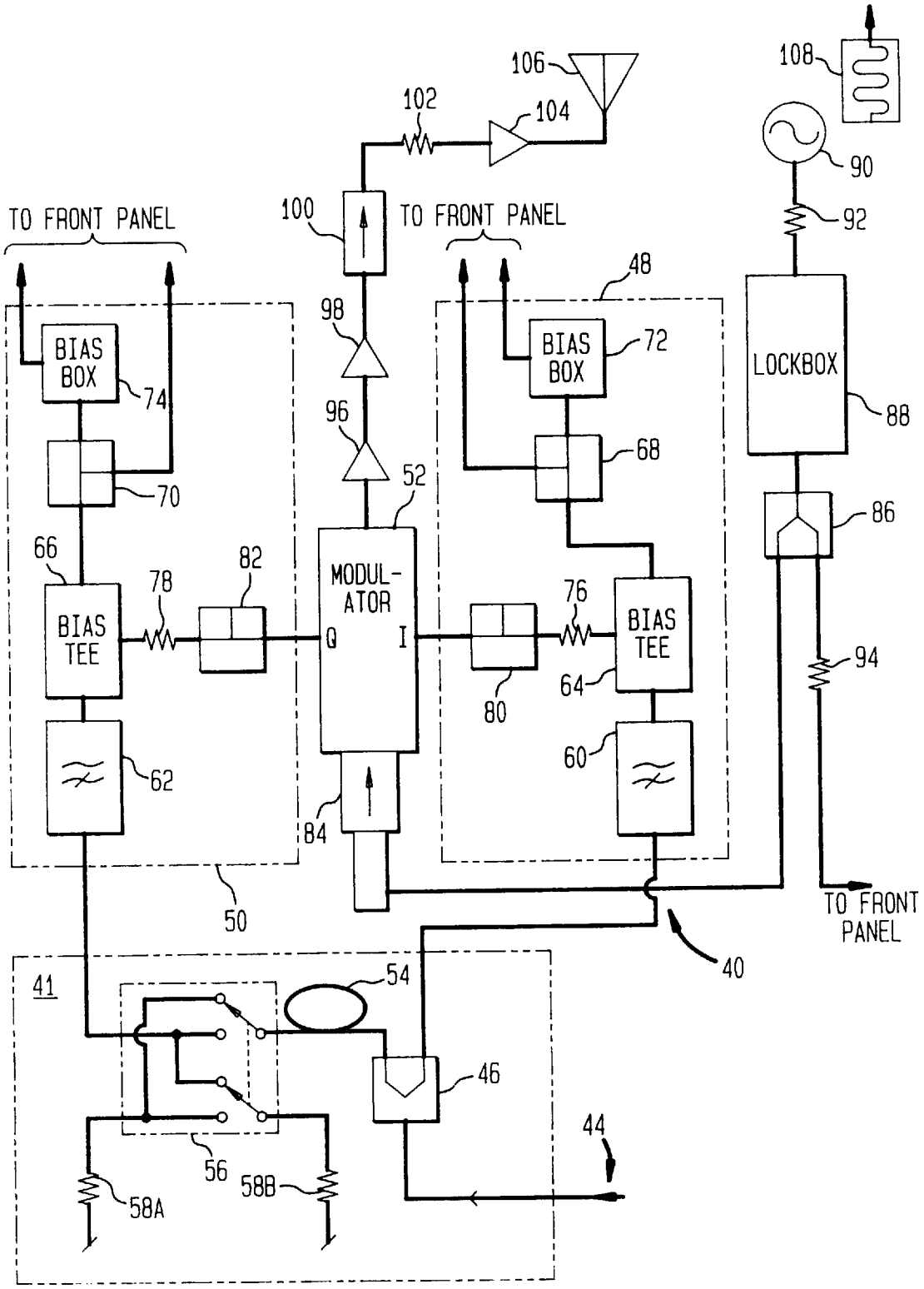
FIG. 4 illustrates a high speed wireless transmitter configured with a test circuit for binary phase shift keying and quadrature phase shift keying transmission.

In an exemplary embodiment, first unit processor 16 of first unit 12 operates at high data rates using disclosed wireless transmitter 40, implemented in embodiments shown in FIGS. 2–4 for transmission using binary phase shift keying, quadrature phase shift keying, and both binary phase shift keying and quadrature phase shift keying with test circuit 41, respectively. Second unit processor 28 of second unit 14 operates at high data rates using disclosed wireless receiver 42, implemented in embodiments shown in FIGS. 5–7 for reception using binary phase shift keying, quadrature phase shift keying, and both binary phase shift keying and quadrature phase shift keying with test circuit 43, respectively. The disclosed transmitters 40 and receivers 42 of FIGS. 2–7 are thus adapted for such high data rate communication.

Referring to FIGS. 2–4, transmitter 40 is configured in illustrative embodiments for high speed transmissions and includes a port for receiving an input signal 44 including an input data stream with a data rate of about 622.08 Megabits per second. In one embodiment, the input data stream can be provided with about 0.5 V offset and input levels within a range of amplitudes of about 0.2 V to about 2.0 V peak-to-peak, such as an input level of about 1.0 V peak-to-peak. Inputs with emitter-collector logic voltage levels can also be applied. Input signal 44 is applied to in-phase (I) control bus or rail 48, and can also be applied to quadrature-phase (Q) control bus or rail 50.

Referring to FIG. 2, the transmitter 40 receives input signal 44 at I rail 48 for binary phase shift keying. In particular, input signal 44 is applied to filter 60 connected to bias tee 64 of I rail 48, and bias tee 66 of Q rail 50 is connected to matched load 58, as described below.

Referring to FIG. 3, the transmitter 40 receives first input signal 44I at I rail 48 and receives second input signal 44Q at Q rail 50 for quadrature phase shift keying, respectively. In particular, input signals 44I, 44Q are applied to filters 60, 62, respectively, which are connected to bias tees 64, 66, respectively, of rails 48, 50, respectively, as described below.

Referring to FIG. 4, transmitter 40 is configured with test circuit 41 to allow one bit stream to simulate quadrature phase shift keying operation, with input signal 44 received from a port connected to splitter 46, such as a Model ZFRSC-42, 6 dB splitter available from "MINICIRCUITS", for splitting the input data stream to be applied to rails 48, 50, respectively, which are operatively connected to transmitter modulator 52.

Transmitter modulator 52 can be implemented and operated in a manner known in the art, such as the modulator described in Gans et al., U.S. Pat. No. 4,612,518, issued Sep. 6, 1986, which is incorporated herein by reference.

As shown in FIG. 4 for transmitter 40 configured with test circuit 41, the Q rail data path includes cable loop 54 configured to delay the input data stream or signal so that transmitter modulator 52 receives two substantially independent bit sequences from rails 48, 50. The Q rail input data path is, for example, about two bit periods longer than the I rail input data path, so that the Q rail delay path is approximately two feet longer than the I rail delay path. It is to be understood that other known techniques for delaying one rail input with respect to the others can be utilized.

Transmit mode switch 56, such as a switch available from "LORAL", is provided in the input path and connected to Q rail 50 to switch between quadrature phase shift keying mode and binary phase shift keying mode; i.e. the data stream is switched to transmitter modulator 52 for quadrature phase shift keying operation at data rates of 1.244 Gigabits per second.

For binary phase shift keying mode, the data stream is switched away from transmitter modulator 52 by switching the data stream to, for example, matched load 58A, such as a 50 Ω resistor connected to ground, and by switching matched load 58B to filter 62 of Q rail 50. The switching of the data stream away from transmitter modulator 52 allows binary phase shift keying operation at data rates of 622.08 Megabits per second.

At each of rails 48, 50, the I input data stream in FIGS. 2–4 is filtered by low pass Butterworth filter 60, and the Q input data stream in FIGS. 3–4 are filtered by low pass Butterworth filter 62. Each Butterworth filter 60, 62 can include Model 2BL2-555 low pass Butterworth filters available from "REACTEL". The filtered data signals output by filters 60, 62 are then passed through bias tees 64, 66, respectively. In the exemplary embodiment, bias tee 64 provides a DC offset for I rail 48 as a carrier-to-data reference in the range of about −7 dB to −10 dB, and bias tee 66 of Q rail 50 controls the phase relationship between I rail 48 and Q rail 50 during reception.

Each of rails 48, 50 can be connected through respective T-splitters 68, 70 to respective bias boxes 72, 74 for providing about a 9 millivolts voltage bias. Each bias box 72, 74 is connected to a bias adjustment control at a front panel (not shown in FIGS. 2–7) of disclosed transmitter 40. Each T-splitter 68, 70 is also connected to a respective bias monitor at the front panel, such as a voltage gauge or the like, for monitoring the bias of each of rails 48, 50, respectively. Adjustment of the I rail bias voltage can be performed using bias box 72 to affect the in-phase carrier reference by adding a relatively small DC bias.

In an exemplary embodiment, adjustments can be performed to provide between about 60 millivolts direct current and about 30 millivolts direct current bias, which can be used to provide a carrier reference which is suppressed from about 7 dB to about 10 dB below the total signal power, respectively.

Adjustment of the Q rail bias can be performed using bias box 74 for varying the phase relationship of rails 48, 50 to control crosstalk. In the exemplary embodiment, the Q rail bias can range between about 0 V to about +5 millivolts.

As shown in FIGS. 2–4, attenuators 76, 78 can be provided between transmitter modulator 52 and respective bias tees 64, 66 of rails 48, 50 to absorb any impedance mismatches between rails 48, 50 and the inputs to transmitter modulator 52, and thereby avoid intersymbol interference due to multiple reflections.

Each attenuator 76, 78 can provide about 9 dB attenuation. One skilled in the art would understand that other attenuators known in the art can be used to correct for impedance mismatches. Optionally respective T-splitters 80, 82 can be provided to observe the data at the modulator inputs to assure that it is free from reflections and at the proper voltage level.

Transmitter modulator 52 is also connected, through radio frequency isolator 84 and splitter 86, such as a Model 4315-2 splitter available from "NARDA", to "CTI" phase-locked source 88, such as a Model P-9353 LOCKBOX source, which provides a half-frequency pump signal of about 9.5 Gigahertz to transmitter modulator 52. Source 88 operates using an input signal of about 10 Megahertz provided by oscillator 90, such as a Model CO272GB37RW VCXO oscillator available from "VECTRON", through attenuator 92 with about 3 dB attenuation.

Splitter 86 can also provide an output signal, through attenuator 94 providing about 10 dB attenuation, to a pilot signal monitor port of the front panel of disclosed transmitter 40 for monitoring the carrier half-frequency pump signal of 9.5 Gigahertz, which can be used as a reference when initially tuning the free running frequency.

Transmitter modulator 52 provides a modulated output signal to at least one amplifier stage. In an exemplary embodiment, two amplifier stages can be used, such as Model AMT-26132 amplifier 96 available from "AVANTEK" providing about +11 dB gain and Model AMT-26175 amplifier 98 available from "AVANTEK" providing about +25 dB gain, for amplifying the output signal by about +36 dB.

The amplified output signal is passed through radio frequency isolator 100 as a 19 Gigahertz output, which can be provided to an indicator on the front panel. The 19 Gigahertz output can then be provided through attenuator 102, which can be a resistor bridge providing about 6 dB attenuation, and then to high power amplifier 104, such as a Model SMW92-1696 power amplifier available from "AVANTEK", which yields a 1 dB gain compression point of about +23 dBm radio frequency output power, for signals whose frequencies are about 19 Gigahertz.

The output signal from amplifier 104 is then provided to antenna 106 on an antenna platform (not shown in FIGS. 2–7). Amplifier 104 and antenna 106 can be connected by, for example, a waveguide adapter and a 20 ft. low-loss coaxial cable, allowing amplifier 104 and antenna 106 to be rotated relative to each other for horizontal and vertical orientations to establish a communication path with a receiver. Antenna 106 can be at least one of antennas 20–24 of first antenna array 18 shown in FIG. 1.

In the exemplary embodiment, antenna 106 of disclosed transmitter 40 can have a variable gain, and can be omnidirectional in configuration or can employ horns of predetermined beamwidths. In a preferred embodiment for high data rate transmissions, antenna 106 can include a narrow beamwidth horn with about 15° beamwidth. Alternatively, an open-ended waveguide, such as a waveguide having about a 6 dB gain, can be used for disclosed transmitter 40. For aligning antenna 106 to receive signals using such a narrow beamwidth, disclosed transmitter 40 can optionally include laser 108, such as a 5 miliwatt laser pointer, for visually aligning the antennas of disclosed transmitter 40 and disclosed receiver 42, described in greater detail below.

Figure 5:
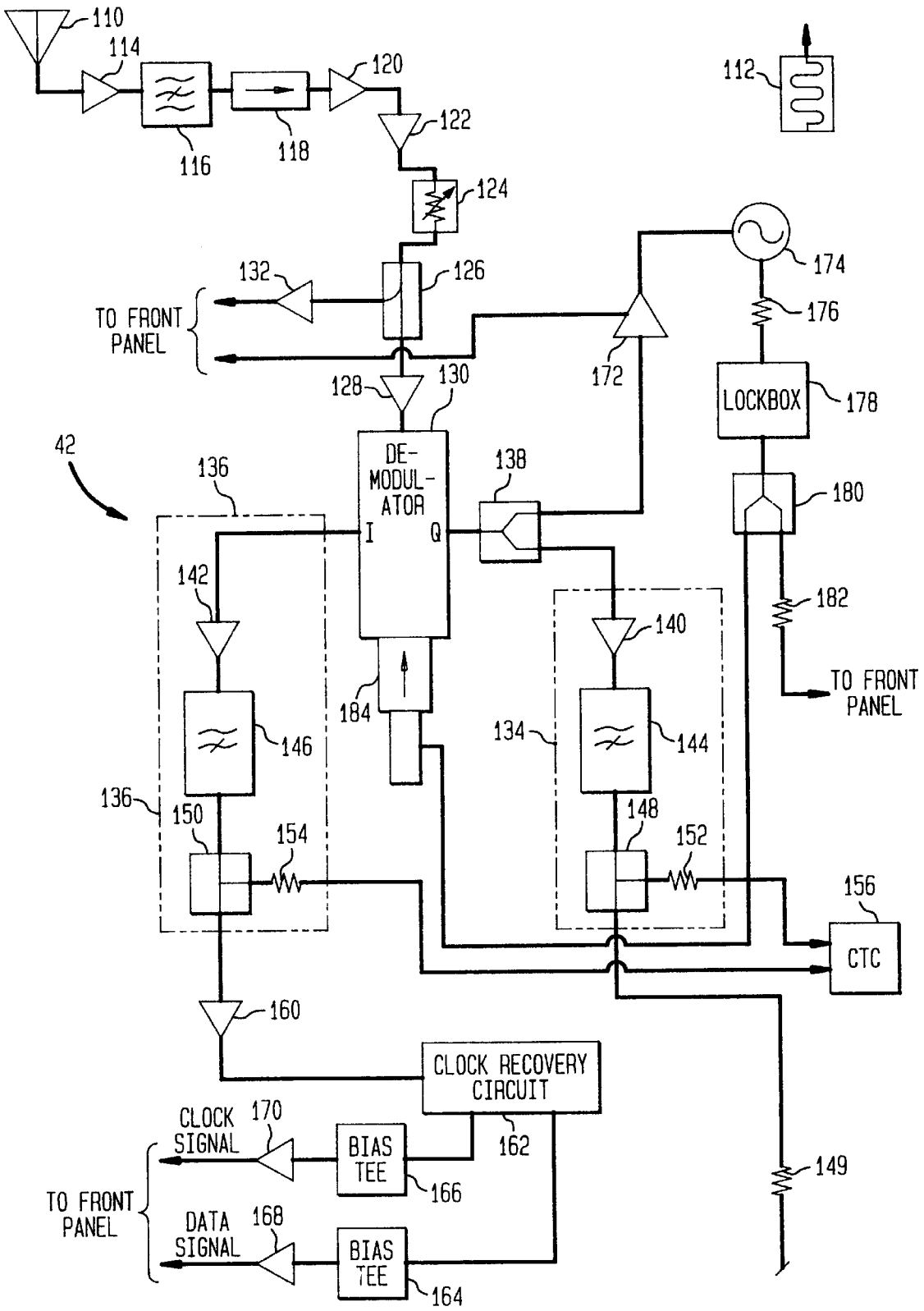
FIG. 5 illustrates a high speed wireless receiver configured for binary phase shift keying reception.
Figure 6:
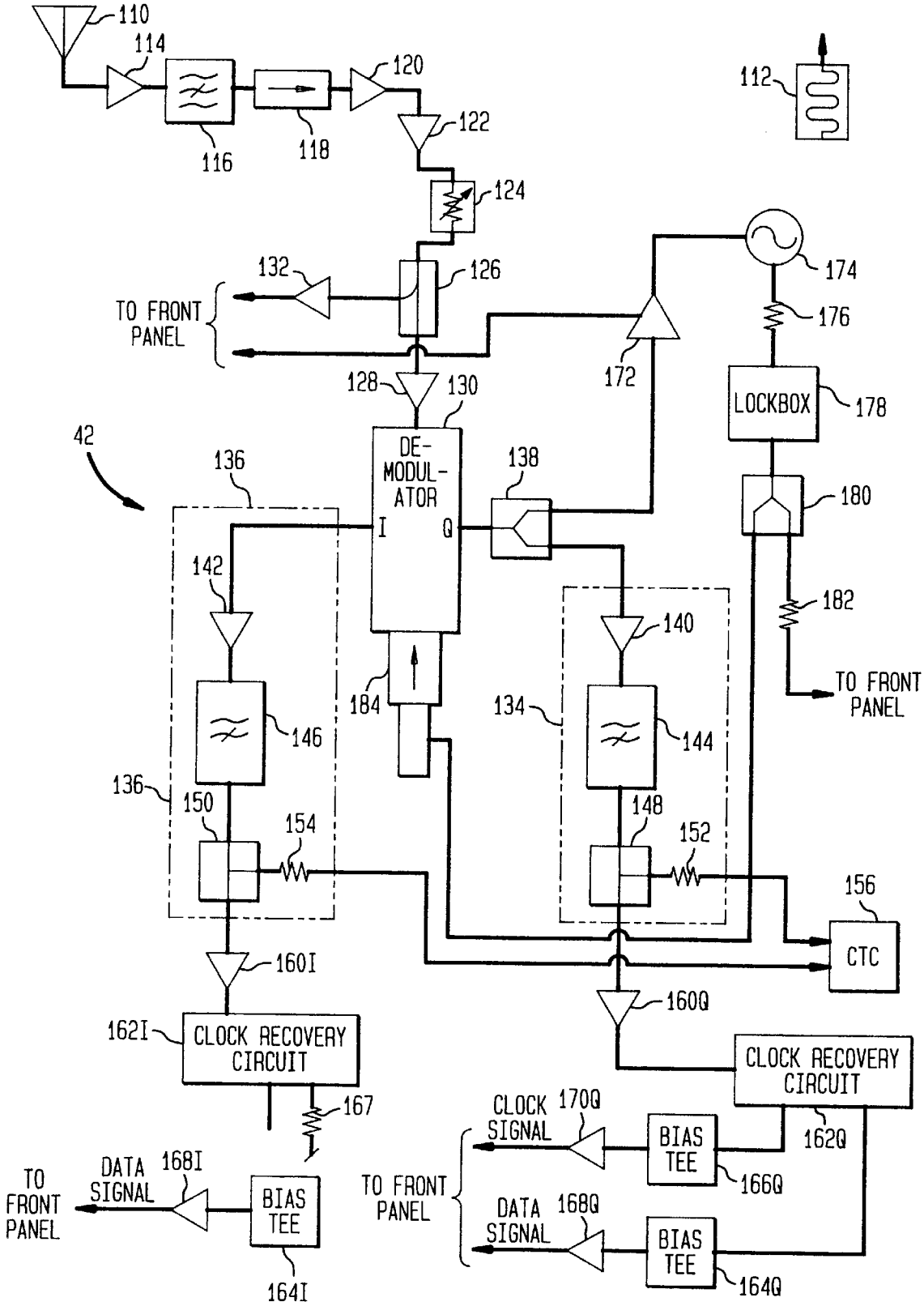
FIG. 6 illustrates a high speed wireless receiver configured for quadrature phase shift keying reception.
Figure 7:
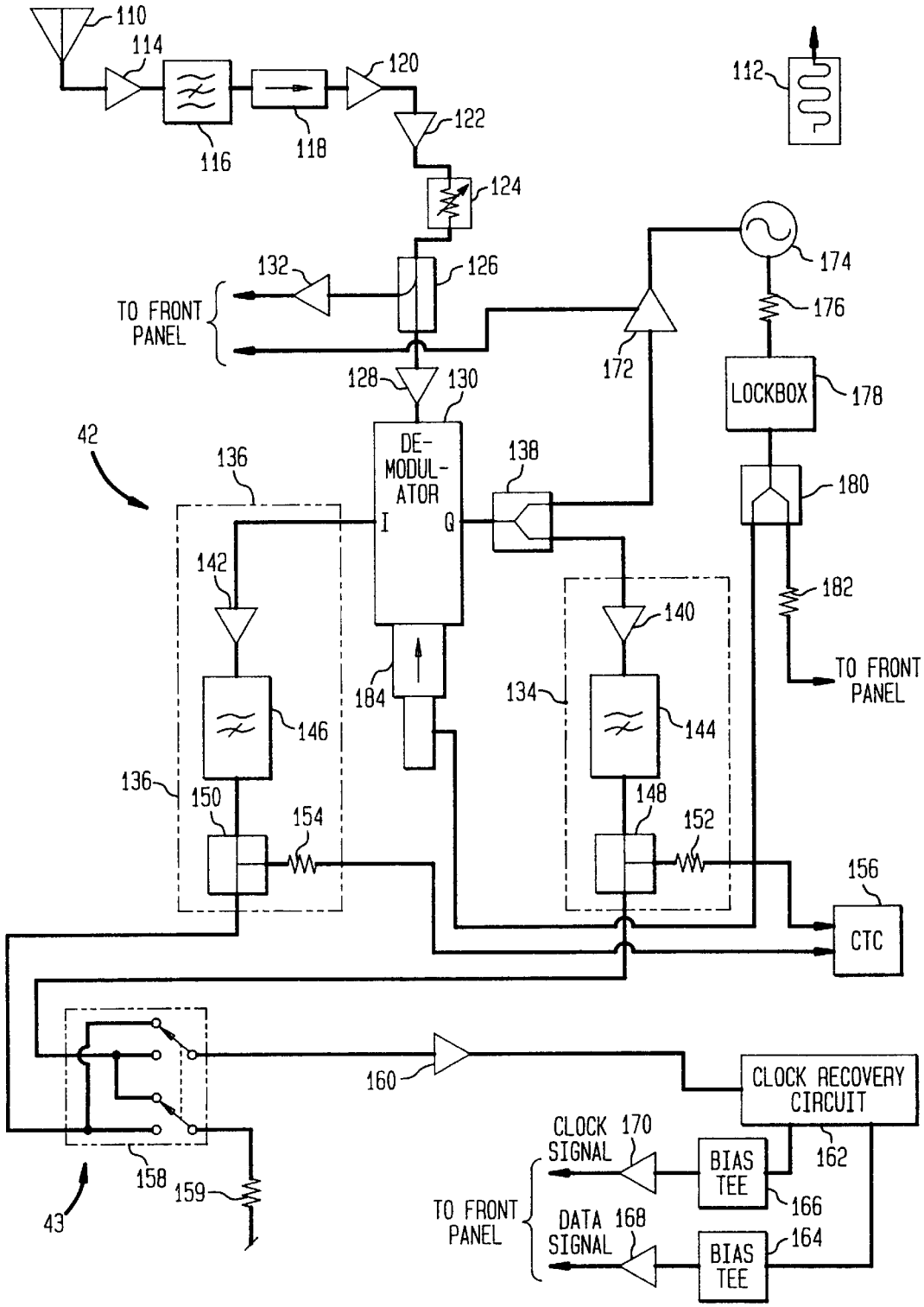
FIG. 7 illustrates a high speed wireless receiver configured with a test circuit for binary phase shift keying and quadrature phase shift keying transmission.

Referring to FIGS. 5–7, receiver 42 is configured in illustrative embodiments for high speed wireless reception, and includes antenna 110 for receiving a high data rate signal at about 19 Gigahertz. Antenna 110 can be at least one of antennas 32–36 of second antenna array 30 shown in FIG. 1.

In the exemplary embodiment, antenna 110 of disclosed receiver 42 can have a variable gain, and can be omnidirectional in configuration or can employ horns of predetermined beamwidths. In a preferred embodiment for high data rate transmissions, antenna 110 can include a narrow beamwidth horn with about 15° beamwidth and a gain of about 22 dB.

For aligning antenna 110 to receive signals using such a narrow beamwidth, disclosed receiver 42 can optionally include laser 112, such as a 5 milliwatt laser pointer, for visually aligning the antennas of disclosed receiver 42 and disclosed transmitter 40.

Antenna 110 can be connected by, for example, a 6 inch semi-rigid coaxial cable and a waveguide adapter, to low-noise amplifier 114, such as a Model SMW92-1694 amplifier available from "AVANTEK" having about a 5.0 dB noise figure and a 1 dB gain compression point of about +14 dBm output power, for signals whose frequencies are about 19 Gigahertz, for providing +31 dB gain. The amplified signal is then provided to 2 Gigahertz bandwidth radio frequency filter 116, such as a Model 45830H-2110 filter available from "HUGHES".

The filtered signal is then passed through radio frequency isolator 118 and amplified by at least one amplifier stage, such as amplifiers 120, 122 which can be, for example, a Model AMT-26175 low-noise amplifier available from "AVANTEK" for providing about +28 dB gain, and a Model AMT-26132 low power amplifier available from "AVANTEK" for providing about +11 dB gain.

The output signal from the amplifier stage is then passed through variable attenuator 124 for radio frequency power control, such as a Model K382 available from "HEWLETT-PACKARD". In an exemplary embodiment, variable attenuator 124 can be external to disclosed receiver 42, and connected to disclosed receiver 42 through external ports or sockets. Alternatively, variable attenuator 124 can be incorporated within wireless receiver 42.

The output signal from variable attenuator 124 is then applied to radio frequency coupler 126, such as a 10 dB Model 4017C-10 coupler available from "NARDA", to apply the output signal for amplification by amplifier 128, such as a Model AMT-26132 low power amplifier available from "AVANTEK", to be applied to an input port of receiver demodulator 130. Receiver demodulator 130 can be implemented and operated in a manner known in the art, such as the demodulator described in Gans et al., U.S. Pat. No. 4,612,518, issued Sep. 16, 1986, which is incorporated herein by reference.

Radio frequency coupler 126 can also generate a 16 dB tap from the output signal to be amplified by amplifier 132, such as an AMT-26175 low-noise amplifier available from "AVANTEK", for output to the front panel to allow the user to monitor and adjust the radio frequency power applied to receiver demodulator 130. Typically, the operating power is about −12 dBm. Amplifier 132 can be used to amplify the 16 dB tap to correspond to the radio frequency power received at the input port of receiver demodulator 130.

In quadrature phase shift keying reception mode, receiver demodulator 130 outputs two demodulated 622.08 Megabits per second bit streams to each of the Q and I rails, respectively; i.e. rails 134, 136. Splitter 138, such as a Model ZFRSC-42, 6 dB splitter available from "MINICIRCUITS", is connected between receiver demodulator 130 and Q rail 134 to split the data stream for monitoring and adjusting receiver demodulator 130 using a first phase lock loop, as described in greater detail below.

Each of rails 134, 136 includes respective amplifiers 140, 142, such as a Model E104 amplifier available from "COMLINEAR"; respective filters 144, 146, such as a Model 1BL2-352 low pass filter available from "REACTEL"; respective coaxial probes 148, 150, such as a Model 5520C 10X coaxial probe, available from "PICOSECOND"; and attenuators 152, 154, which can be embodied as resistors to avoid reflections from circuits connected thereafter.

Coaxial probes 148, 150 can be used to tap the I and Q signals off and passed through attenuators 152, 154, respectively, to optional crosstalk canceler circuit 156. Crosstalk canceler circuit 156 can be implemented as a second, slow phase-lock loop to compensate for temperature drift, and as a detector for an automatic gain control circuit.

For receiver 42 configured to operate in binary phase shift keying mode shown in FIG. 5, the output of coaxial probe 148 is applied to matched load 149, and the output of coaxial probe 150 is applied to amplifier 160 for amplification and output to clock recovery circuit 162 which generates signals applied to bias tees 164, 166 and amplifiers 168, 170, respectively, to generate a clock signal and a data signal, respectively, which are output to the front panel.

For receiver 42 configured to operate in quadrature phase shift keying mode shown in FIG. 6, the output coaxial probes 148, 150 are applied to amplifiers 160Q, 160I, respectively, for amplification and output to clock recovery circuits 162Q, 162I, respectively, which generates signals applied to bias tees 164Q, 166Q and to bias tee 164I and matched load 167, respectively. The outputs of bias tees 164I, 164Q, and 166Q are amplified by amplifiers 1681, 168Q, and 170Q, respectively, to generate a data signals and a clock signal, respectively, which are output to the front panel.

For receiver 42 configured to operate with test circuit 43, including switch 158 and matched load 159, in binary phase shift keying and quadrature phase shift keying modes shown in FIG. 7, the output coaxial probes 148, 150 are applied to switch 158, which is a radio frequency transfer switch such as a double-pole, double-throw switch available from "LORAL" and disposed on the front panel for control by the user to select between the I rail data and the Q rail data.

In binary phase shift keying test mode, the data is provided by I rail 136, and the output of Q rail 134 is applied to matched load 159. In quadrature phase shift keying test mode, the data is provided by either I rail 136 or Q rail 134, and the output of Q rail 134 or I rail 136, respectively, is applied to matched load 159. In either mode, the data switched and output by switch 158 to be amplified by amplifier 160, such as a Model E104 amplifier available from "COMLINEAR", and applied to clock recovery circuit 162, such as a Model 1313RF receiver available from AT&T. Clock recovery circuit 162 generates a data signal and a clock signal, each of which is applied to respective bias tees 164, 166 and to respective amplifiers 168, 170, such as a Model ZFL2000 amplifier available from "MINICIRCUITS", to generate a data signal with a data rate of about 622.08 Megabits per second, and a clock signal which are output to the front panel of disclosed receiver 42. The output amplitude of each of the data signal and clock signal is about 400 millivolts peak-to-peak.

Referring to FIGS. 5–7, the output from splitter 138 is applied to phase-lock loop amplifier and filter 172, controlled by the user through the front panel for fine and coarse adjustment of the 9.5 Gigahertz pilot carrier. The coarse adjustment can be performed within a range of about 3.6 Megahertz, and the fine adjustment can be performed within a range of about 1 Megahertz.

The amplified output of amplifier and filter 172 is applied to oscillator 174, such as a Model 233Y1852 Non-Ovenized VCXO oscillator available from "VECTRON", to control the pilot signal generated and provided by oscillator 174 to attenuator 176 and "CTI" phase-locked source 178, such as a Model P-9353 LOCKBOX source. The output of source 178 is applied to splitter 180, such as a Model 4315-2 splitter available from "NARDA". One output of splitter 180 is applied, through attenuator 182 such as a 10 dB attenuator, to a pilot signal monitor port of the front panel of disclosed receiver 42 for monitoring the carrier half-frequency derived from pump oscillator 174 to perform tuning of the free-running frequency of disclosed receiver 42. The second output of splitter 180 is applied to radio frequency isolator 184 for input to receiver demodulator 130.

In the above illustrative embodiments, disclosed transmitter 40 and receiver 42 are capable of a coherent quadrature phase shift keying mode as well as a binary phase shift keying mode, using corresponding modulators and demodulators, to achieve the desired high speed data transmission rates. For example, in quadrature phase shift keying mode, the disclosed transmitter 40 has two 622.08 Megabits per second data streams provided to I rail 48 and Q rail 50 connected to quadrature phase shift keying modulator 52 which produces a 1.244 Gigabits per second data output.

A relatively small DC bias is applied to Q rail 134 of receiver demodulator 130 of disclosed receiver 42, which balances the phasing of receiver demodulator 130 in quadrature phase shift keying mode to reduce crosstalk. Eye diagram symmetry can be improved by applying a small direct current bias to the I rail 136.

In binary phase shift keying mode, for example, disclosed transmitter 40 has a data stream provided to I rail 48 of transmitter modulator 52, which can have Q rail 50 of the modulator terminated to ground, to yield a 622.08 Megabits per second data stream output. I rail 136 of receiver demodulator 130 receives the received signal, and Q rail 134 is used as the phase detector output for the phase-lock loop of receiver 42.

Figure 8:
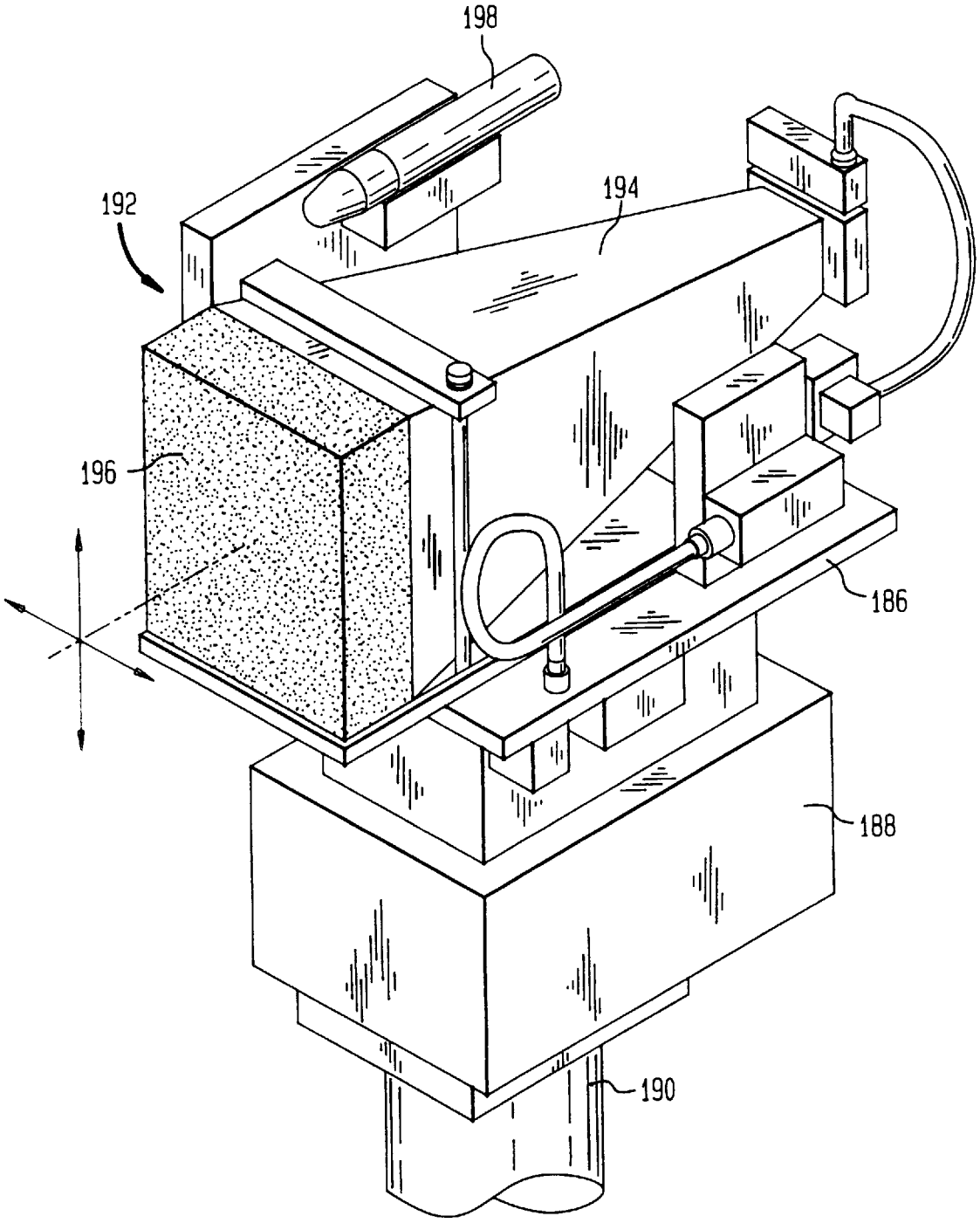
FIG. 8 is a perspective view of an exemplary antenna configuration.

As shown in an exemplary embodiment in FIG. 8, either of antennas 106, 110 of disclosed transmitter 40 and disclosed receiver 42, respectively, can be mounted on platform 186 connected to pan/tilt device 188 and adjustable base 190 including tripods (not shown in FIG. 8) which allow for floor-to-ceiling tilts and azimuth adjustment of narrow beamwidth antenna 192 within predetermined ranges; for example, 15° tilt angles and 90° panning angles. The orientation of the antenna on platform 186 can be remotely controlled using a motorized remote controlled mechanism known in the art and included in pan/tilt device 188.

The narrow beamwidth antenna shown in FIG. 8 can include horn 194 and protective cover 196 known in the art for protecting the interior of horn 194 from dust particles and other objects. Laser 198 can be mounted, for example, approximately 2 inches over the top center of horn 194 and can lie parallel to a longitudinal center-line of horn 194. Laser 198 can operate as either of lasers 108, 112 of FIGS. 2–7, so that complementary transmitters and receivers can be configured to establish a communication path therebetween.

In an alternative embodiment, disclosed transmitter 40 and receiver 42 can be combined in a transceiver combination, where antenna 106 of FIGS. 2–4, respectively, can be used as antenna 110 of FIGS. 5–7, respectively.

In an exemplary configuration, the radio link signal margin M can be determined from the difference between the actual $E_b/N_o$ of the link and a determined $E_b/N_o$ of the high speed wireless telecommunication system.

The link margin M (in dB) can be determined to be $$M=P_t+G_t+G_r-(E_b/N_o)_{DESIRED}-R-k-T_o-L_s-L_c-L_o$$

where:

$P_t$ is the transmitter power, in dBW;

$G_t$ is the transmitter antenna gain, in dBi, for an open ended waveguide;

$G_r$ is the receiver antenna gain, in dBi, for a standard gain horn;

$E_b$ is the energy per bit, in joules;

$N_o$ is the noise power spectral density, in watts/Hz;

$(E_b/N_o)_{DESIRED}$ is the $E_b/N_o$ determined to achieve a desired system performance, such as 12.6 dB for coherent binary phase shift keying with a bit error rate of about $10^{-9}$;

R is the data rate, in dB-bps, where R is about 10 log (622 Megabits per second) for binary phase shift keying and 10 log (1.244 Gigabits per second) for quadrature phase shift keying;

k is Boltzmann's constant, which is about −228.6 dBW/K-Hz;

$T_o$ is the system noise temperature, in dBK, which can be about 10 log $[T_{ANT}+(F-1) * 290]$, where $T_{ANT}$=290 K, so $T_o=24.6+F_{dB}$, where $F_{dB}$=10 log (F) is a composite noise factor of the receiver pre-amplifier, which can be, for example, about 5.5;

$L_s$ is the system and implementation loss, in dB;

$L_c$ is the cable loss, in dB; and $L_o$ is the free space path loss, in dB, where $L_o$ is about 10 log $(4\pi\, d/\lambda)^2$, where $\lambda$=0.015 m at about 19 Gigahertz.

For example, for a carrier frequency of 19 Gigahertz, a bit error rate of about $10^{-9}$, and a distance of 5 m, $P_t$=−7 dBw, $G_t$=6 dBi, $G_r$=15.5 dBi, $(E_b/N_o)_{DESIRED}$=12.6, R=87.9 dB-bps, k=−228.6 dBW/K-Hz, $T_o$=(24.6+5.5) dBK=30.1 dBK, $L_s$=3 dB, $L_c$=2 dB, and $L_o$=72 dB. Thus, M=35.5 dB for binary phase shift keying and 32.5 dB for quadrature phase shift keying, which has twice the data rate.

Thus, the radio link can tolerate losses due to wall attenuation, other obstructions, or multipath of about 32.5 dB at about 5 meters. Alternatively, at a distance of about 10 meters, the margin M is about 26.5 dB.

Figure 9:
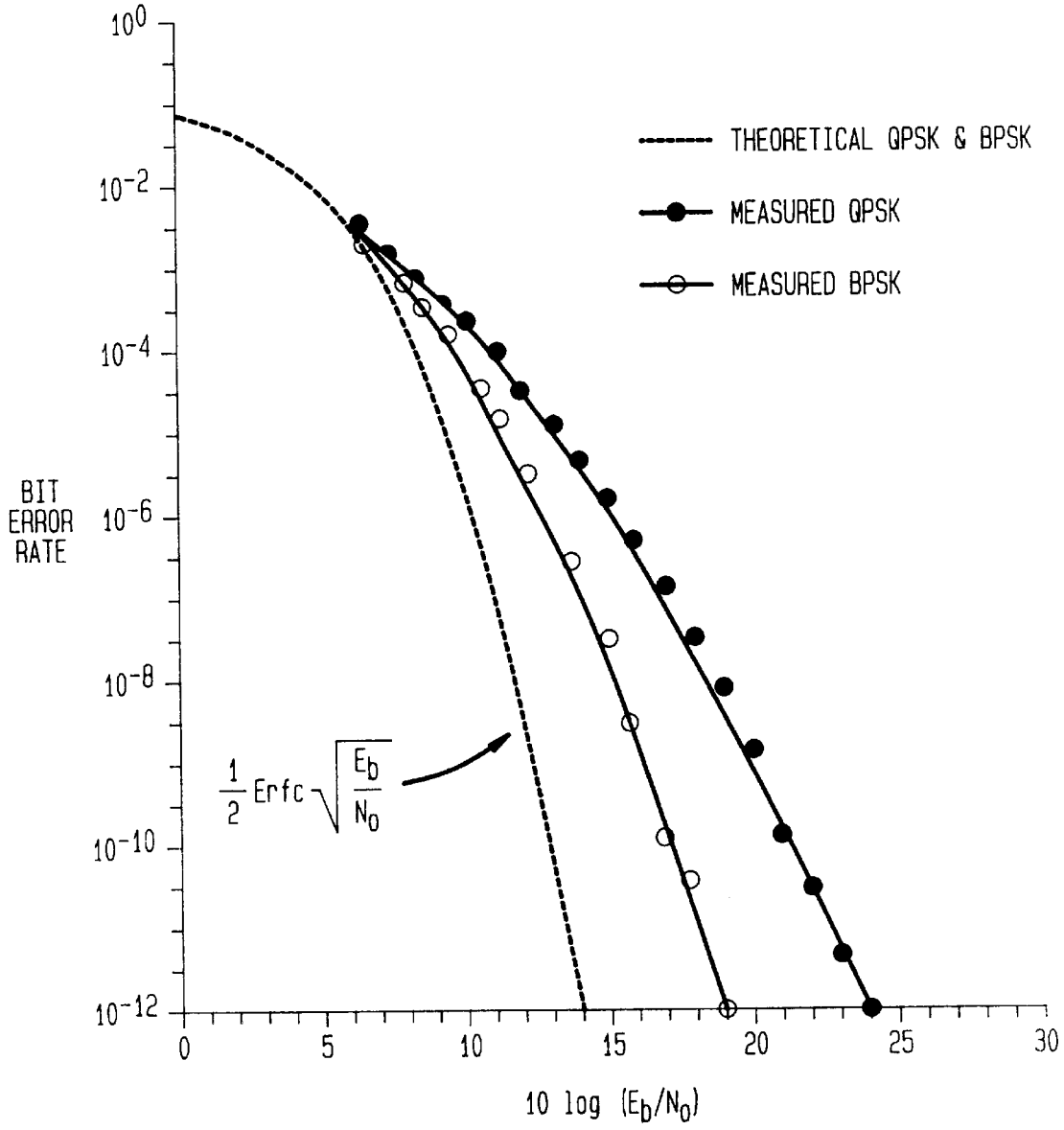
FIG. 9 is a graph of plotted bit error rate values.

As shown in FIG. 9, bit error rate vs. $E_b/N_o$ values are plotted for both quadrature phase shift keying and binary phase shift keying operation of receiver 42 of FIGS. 5–7, in comparison with an ideal theoretical performance curve representing:

$$\frac{1}{2}\, Erfc\sqrt{\frac{E_b}{N_o}}\ .$$

The plotted quadrature phase shift keying curve is an average of the performance of rails 134, 136. In generating the data of FIG. 9, measurements are obtained using a pseudo-random bit sequence of $2^{23}-1$, with the antennas bypassed to eliminate any non-system interference.

For $E_b=P_s/R$ and $N_o=P_n/B_w$, then $$10\log_{10}(E_b/N_o)=10\log_{10}[(P_s/P_n)\,(B_w/R)],$$

where $E_b$ is the energy per bit, in joules;

$N_o$ is the noise power spectral density, in watts/Hz;

$P_s$ is the signal power, in dBm, measured at the input of the receiver demodulator 130;

$P_n$ is the noise power, in dBm, measured at the input of the receiver demodulator 130;

$B_w$ is the noise bandwidth, in Megahertz; and

R is the bit rate, in Megabits per second.

The noise bandwidth $B_w$ can be determined by plotting the dB gain, D(f) of the radio frequency filter 116 of the receiver demodulator 130 over about a 2.5 Gigahertz spectral range by the following equations:

$$G(f)=10^{\frac{D(f)}{10}}$$

$$B_w=100\text{ MHz}*\frac{\sum_{i=1}^{25}G(f_i)}{G_p}=2.1\text{ GHz}$$

where $G_p$ is the peak filter gain, and the samples $f_i$ in the summation are determined at about 100 Megahertz increments.

While the disclosed transmitter and receiver and methods of use have been particularly shown and described with reference to the preferred embodiments, it will be understood by those skilled in the art that various modifications in form and detail can be made therein.

What is claimed is:

1. A wireless telecommunications device comprising:

an antenna array having at least two antenna elements, each antenna element providing beam coverage in both azimuthal and elevational directions; and a processor operatively connected to the antenna array for determining a communication path meeting a predetermined signal power and delay of received signals with respect to one of the at least two antenna elements.

2. The wireless telecommunications device of claim 1 further comprising:

means for adjusting the orientation of one of the at least two antenna elements to determine the communication path.

3. The wireless telecommunications device of claim 1 further comprising:

a laser pointing device for aligning one of the at least two antenna elements.

4. The wireless telecommunications device of claim 1 wherein the at least two antenna elements have an azimuth and elevation beamwidth of less than about 30°.

5. The wireless telecommunications device of claim 2 wherein the at least two antenna elements have a beamwidth of about 15°.

6. The wireless telecommunications device of claim 1 wherein the processor, using the communication path, communicates via wireless communications with high data rates in excess of about 10 Megabits per second.

7. The wireless telecommunications device of claim 1 wherein the processor determines the communication path between a plurality of rooms.

8. The wireless telecommunications device of claim 1 wherein the processor determines the communication path to establish wireless communications.

9. The wireless telecommunications device of claim 1 wherein the processor includes:

transmitter means for generating an output signal from a data signal for transmission by the antenna array.

10. The wireless telecommunications device of claim 9 wherein the transmitter means operates in a selected mode including a quadrature phase shift keying mode and a binary phase shift keying mode.

11. The wireless telecommunications device of claim 1 wherein the processor includes:

receiver means for processing a signal to generate a data signal therefrom.

12. The wireless telecommunications device of claim 11 wherein the receiver means operates in a selected mode including a quadrature phase shift keying mode and a binary phase shift keying mode.

13. A wireless telecommunications system comprising:

a base station; and a plurality of remote stations;

wherein the base station and each remote station includes:

an antenna array having at least two antenna elements, each antenna element having a predetermined beamwidth for coverage in both azimuthal and elevational directions; and a processor operatively connected to the antenna array for determining a communication path between the base station and the plurality of remote stations meeting a predetermined signal power and delay of received signals, including propagation losses of about 32.5 dB relative to five meters.

14. The wireless telecommunications system of claim 13 wherein the base station and each of the plurality of remote stations includes:

means for adjusting the orientation of one of the at least two antenna elements to determine the communication path.

15. The wireless telecommunications system of claim 13 wherein the antenna array includes a plurality of antenna elements adapted for orientation to determine the communication path.

16. The wireless telecommunications system of claim 13 wherein the antenna array includes a plurality of antenna elements, with a first antenna element adapted to be selected to determine the communication path.

17. The wireless telecommunications system of claim 13 wherein the antenna array includes a plurality of antenna elements adapted to be phased to determine the communication path.

18. The wireless telecommunications system of claim 13 wherein the base station and each of the plurality of remote stations includes:

a laser pointing device for aligning one of the at least two antenna elements to determine the communication path.

19. The wireless telecommunications system of claim 13 wherein the at least two antenna elements have an azimuth and elevation beamwidth of less than about 30°.

20. The wireless telecommunications system of claim 13 wherein the at least two antenna elements have a beamwidth of about 15°.

21. The wireless telecommunications system of claim 13 wherein the processor, using the communication path, communicates via wireless communications with high data rates in excess of about 10 Megabits per second.

22. The wireless telecommunications system of claim 13 wherein the processor determines the communication path between a plurality of rooms.

23. The wireless telecommunications system of claim 13 wherein the processor determines the communication path to establish wireless communications.

24. The wireless telecommunications system of claim 13 wherein the processor includes:

transmitter means for generating an output signal from a data signal for transmission by the antenna array.

25. The wireless telecommunications system of claim 24 wherein the transmitter means operates in a selected mode including a quadrature phase shift keying mode and a binary phase shift keying mode.

26. The wireless telecommunications system of claim 13 wherein the processor includes:

receiver means for processing a signal to generate a data signal therefrom.

27. The wireless telecommunications system of claim 26 wherein the receiver means operates in a selected mode including a quadrature phase shift keying mode and a binary phase shift keying mode.

28. A wireless telecommunications system comprising:

an antenna array having at least two antenna elements, each antenna element providing beam coverage in both azimuthal and elevational directions using a narrow beamwidth antenna element for establishing an optimum communication path; and a processor operatively connected to the antenna array for determining the optimum communication path with respect to one of the at least two antenna elements for transmitting and receiving signals along said optimum communication path where said signals propagating along the optimum communication path exhibit the lowest attenuation in signal power as compared to signals propagating in communication paths other than the optimum communication path, the processor including:

a transmitter having a modulator for modulating a data signal for transmission by the antenna array along said optimum communication path; and a receiver having a demodulator for demodulating a received signal received from the antenna array along said optimum communication path.

29. The wireless telecommunication system of claim 28 wherein each of the transmitter and receiver operates in a selected mode including a quadrature phase shift keying mode and a binary phase shift keying mode.

* * * * *